United States Patent [19]

Sano et al.

[11] Patent Number: 4,599,959

[45] Date of Patent: Jul. 15, 1986

[54] METHOD OF PRODUCING PATTERNS OF ZIGZAG STITCHES

[75] Inventors: Yasuro Sano; Eiji Murakami, both of Tokyo, Japan

[73] Assignee: Janome Sewing Machine Industry Co., Ltd., Japan

[21] Appl. No.: 704,112

[22] Filed: Feb. 22, 1985

[30] Foreign Application Priority Data

Feb. 22, 1984 [JP] Japan ..... 59-30410

[51] Int. Cl.[4] ..... D05B 3/02

[52] U.S. Cl. ..... 112/266.1; 112/456; 112/458

[58] Field of Search ..... 112/158 E, 266.1, 262.1, 112/158 R, 158 B, 102, 103, 78, 453, 456, 457, 458

[56] References Cited

U.S. PATENT DOCUMENTS 4,177,744 12/1979 Wurst et al. ..... 112/158 E
4,342,271 8/1982 Socha ..... 112/158 E
4,416,209 11/1983 Susumu ..... 112/266.1

*Primary Examiner*—Peter Nerbun

*Attorney, Agent, or Firm*—William A. Drucker

[57] ABSTRACT

In stitching operation with an electronic sewing machine storing a plurality of stitch control data, a fabric feeding amount for a specific pattern composed of densely arranged zigzag stitches is automatically controlled in a selective one of normal mode and alternate mode. The fabric feeding amount is usually controlled in the normal mode whereby a fabric feeding amount of a predetermined value or a manually selected value is constantly applied to every stitch of the pattern. The normal feed control mode is switched to the alternate feed control mode when the operator selects a fabric feeding amount smaller than a predetermined critical value, in which case the selected pattern composed of densely arranged zigzag stitches is produced with the fabric being fed in an amount double the selected value each time an alternate one of the zigzag stitches is produced. In the alternate feed control mode, a fabric feeding amount to be applied to the first stitch of the pattern is zero or of a value double the selected amount, which is determined depending upon the shape of the pattern and the needle position at the first stitch of the pattern.

3 Claims, 11 Drawing Figures

METHOD OF PRODUCING PATTERNS OF ZIGZAG STITCHES

BACKGROUND OF THE INVENTION

This invention relates to a method of producing patterns of zigzag stitches with an electronic sewing machine of a type wherein each stitch pattern is stored in the form of an electronic stitch control information data which is selectively read out to generate a corresponding electronic stitch control signal.

An electronic sewing machine of a type described above has been generally known and is capable of producing various stitch patterns. In the electronic sewing machine a fabric feeding amount or pitch is generally controlled by a pulse motor via link mechanism to adjust an inclination of a fabric feed regulator. In this case, the minimum critical amount of the fabric feed is determined by the minimum angular step of the pulse motor and therefore the adjustment of the fabric feed amount is strictly limited to the integral times of the value determined by the minimum feeding amount, resulting in difficulties of minute adjustment of the fabric feed amount to meet the respective stitching requirements.

For example, such embroidery patterns as shown in FIG. 1 comprising a plurality of zigzag stitches must be densely produced with fabric feed amount being made substantially small.

FIG. 2 shows the pattern A of such embroidery stitch patterns, which is stitched in a conventional manner. More particularly, a predetermined feeding pitch P is provided to every stitch. If the minimum feeding pitch determined by the minimum angular step of the pulse motor is 0.2 mm, then the feeding pitch P can be selected to 0.2 mm, 0.4 mm, 0.6 mm—but can not be given values of 0.1 mm, 0.3 mm and 0.5 mm.

In order to obtain such a smaller adjusting step of the fabric feeding amount, it is required to more reduce the minimum angular step of the pulse motor. In this case, however, the control time of the pulse motor becomes longer and accordingly the sewing machine must be driven at a reduced speed, impairing efficiency of stitching operation.

SUMMARY OF THE INVENTION

An object of the invention is therefore to eliminate the defects and disadvantages of the prior art which may have been encountered when specific patterns are produced with densely arranged zigzag stitches with an electronic sewing machine.

Another object of the invention is to variably adjust the fabric feed amount or pitch applied to zigzag stitches, which may be of a value other than those simply determined by the minimum angular step of a pulse motor employed in the sewing machine.

It is still another object of the invention to produce the zigzag stitches of virtually balanced feeding amounts or pitches with respect to the specific patterns requiring densely arranged stitches, without changing the minimum angular step of the pulse motor.

According to an aspect of the invention there is provided a method of producing patterns of zigzag stitches on a fabric with a sewing machine having an electronic memory storing stitch control information for said patterns, said stitch control informations including data for controlling a position of a needle with respect to the fabric and data for controlling a fabric feeding amount with respect to the needle, said needle position control data and said fabric feeding amount control data being selectively and sequentially read out from the electronic memory to control formation of the patterns, which comprises the steps of selecting one of the patterns composed of densely arranged zigzag stitches each accompanied by a predetermined fabric feeding amount, selecting an adjustment of the predetermined fabric feeding amount of the selected pattern, selecting a digital value required for the adjustment of the predetermined fabric feeding amount of the selected pattern to a value not exceeding a predetermined critical value, and driving the sewing machine to cause the same to produce the selected pattern with a fabric feeding amount which has a double value of the selected digital value and which is applied to the fabric each time the alternate one of the zigzag stitches is produced.

BRIEF DESCRIPTION OF THE DRAWINGS

Further objects and advantages of the invention can be fully understood from the following detailed description when read in conjunction with the accompanying drawings, in which.

PREFERRED EMBODIMENTS OF THE INVENTION

The method of the invention will be applied when such patterns as shown in FIG. 1A to FIG. 1D are to be stitched which must be densely produced with zigzag stitches for obtaining beautiful appearance thereof.

Figure 1A:
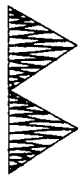
FIGS. 1A–1D are views showing examples of specific patterns made of densely arranged zigzag stitches.
Figure 1B:
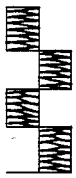
Figure 1C:
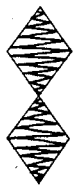
Figure 1D:
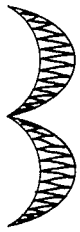
Figure 2:
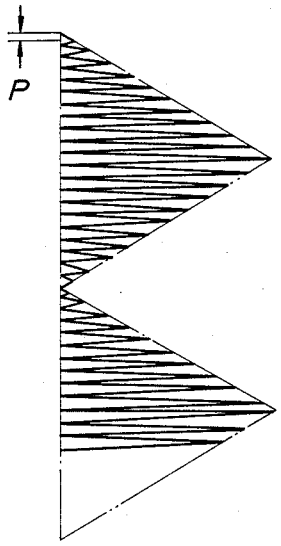
FIG. 2 is a view showing one of the stitch patterns shown in FIG. 1, on an enlarged scale, which is produced in the conventional fabric feeding manner.
Figure 4:
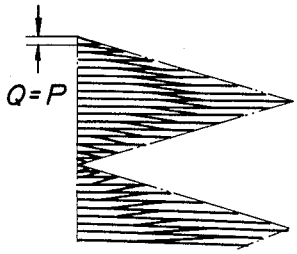
FIGS. 3 through 5 are views of the same pattern as shown in FIG. 2 which are, in turn, respectively produced in the fabric feeding manners according to the invention.
Figure 5:
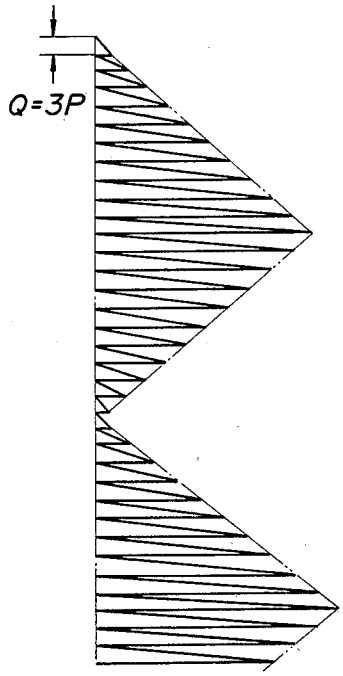
Figure 3:
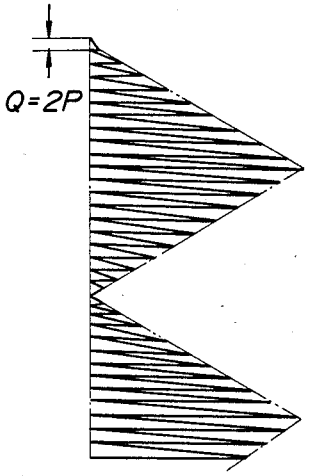

According to the method of the invention, fabric feed operation may be intermittently applied to the stitches, that is, a fabric feed amount of Q is applied to alternate stitches in the pattern A, as shown in FIGS. 3 to 5, which should be compared to the conventional method shown in FIG. 2 wherein the same fabric feed amount of P is applied to every stitch. In the embodiment shown in FIG. 3, the intermittently applied fabric feed amount Q is 2P so that the average fabric feed amount is $Q/2=P$, meaning that the pattern A thus formed will be given appearance equivalent to that of the pattern in FIG. 2 produced by the conventional method.

FIGS. 4 and 5 illustrate the same pattern A which is produced by the method of the invention with the intermittently applied fabric feed amount Q being P and 3P, respectively. Thus, if the fabric feed pitch P=0.2 mm which will be the minimum pitch determined by the minimum angular step of the pulse motor actually used in the sewing machine, the average or apparent fabric feed amount Q/2 in FIGS. 4 and 5 is 0.1 mm and 0.3 mm respectively.

The foregoing will mean that according to the method of the invention, if the minimum feed pitch P is 0.2 mm as usual and conventional, it is possible to adjustably increase or decrease the feeding pitch by 0.1 mm.

Figure 6:
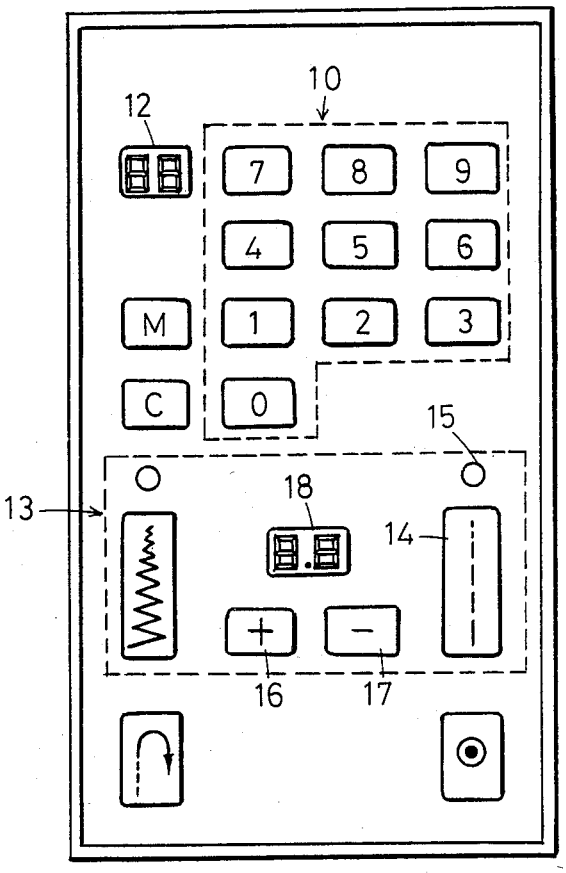
FIG. 6 is a view showing a pattern selection panel usually mounted on a front portion of an electronic sewing machine adapted to carry out the method of the invention.
Figure 7:
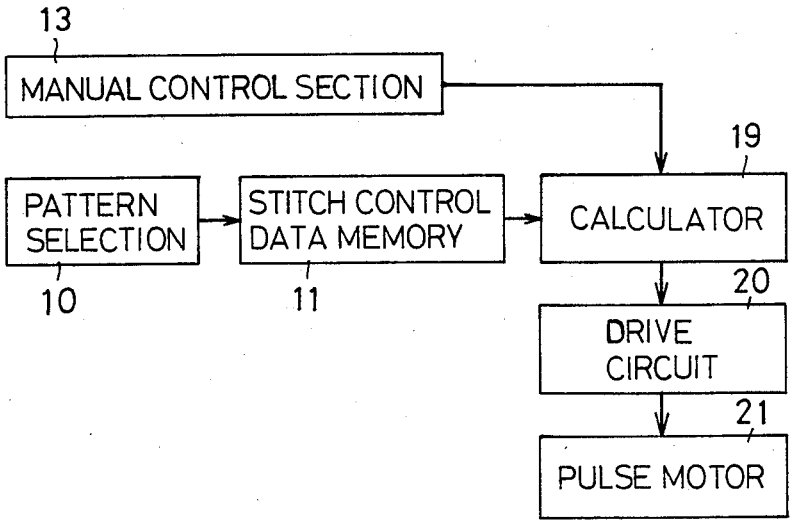
FIG. 7 is a block diagram of fabric feed control operation according to the invention.

Pattern memory and selection system in the electronic sewing machine is known and therefore detailed description thereof is omitted herein. In summary, various stitch patterns that can be automatically produced with the electronic sewing machine are diagrammatically illustrated on the underside of a top cover plate, for example, and marked with reference numerals specific thereto. Now, in reference to FIG. 6, the patterns may be selected by operating a pattern selection unit 10 comprising ten-key switches 0–9 arranged on the front panel of the sewing machine to designate their specific pattern numbers, so that the stitch control data of the selected patterns stored in a stitch control data memory 11 (FIG. 7) is read out to produce the patterns. The selected pattern number is indicated in a display 12 for confirmation purpose.

The reference numeral 13 denotes a manual control section, including a button 14 operative to manually adjust the fabric feed amount. More particularly, the manual feed control button 14 is operated after the selection of a pattern to thereby illuminate a lamp 15 which indicates the manual feed control being ready to operate. Thus, the predetermined set value of the fabric feeding amount specific to such a kind of stitch patterns can be increased or decreased by operating a selective one of buttons 16 and 17. The adjusted value is represented in millimeters at a display 18.

When one of the patterns A–D as shown in FIG. 1 is selected, the fabric feed amount is designed to be automatically set to 0.4 mm, in this embodiment. Thus, the digit of "0.4" is shown at the display 18, then one of the patterns A–D is selected and then the button 14 is operated. The successive operation of the button 16 will increase the feed amount to 0.5 mm, 0.6 mm, 0.8 mm, 1.0 mm and further to values each increasing by 0.2 mm, while the successive operation of another button 17 will reduce the figure to 0.3 mm, 0.2 mm and 0.1 mm. Thus, according to the invention, the intermediate values of 0.1 mm, 0.3 mm and 0.5 mm which can not have been obtained according to the conventional method, may also be choosed in addition to the regular values of 0.2 mm, 0.4 mm, 0.6 mm, 0.8 mm, 1.0 mm—which are progressively increasing by 0.2 mm.

The manual set value of 0.5 mm is a critical point in the fabric feed control of this embodiment. More particularly, when the fabric feed amount is manually adjusted to 0.5 mm or smaller, a pattern data calculator 19 is operated in response to electronic signals supplied from the pattern data memory 11 and the manual control section 13 such that the set value F of the fabric feed amount is modified into 2F and zero, which will alternately applied be to a pulse motor 21 driven by a drive circuit 20. Whereas, the manual selection of the fabric feed amount to be a value exceeding 0.5 mm will result in the normal fabric feed operation so that the fabric feed of the selected amount is applied to every stitch, as in the conventional manner. In this normal fabric feed operation, the feed amount will be adjusted to any one of the values each increasing by 0.2 mm which will correspond to the minimum angular step of the pulse motor 21.

Figure 8:
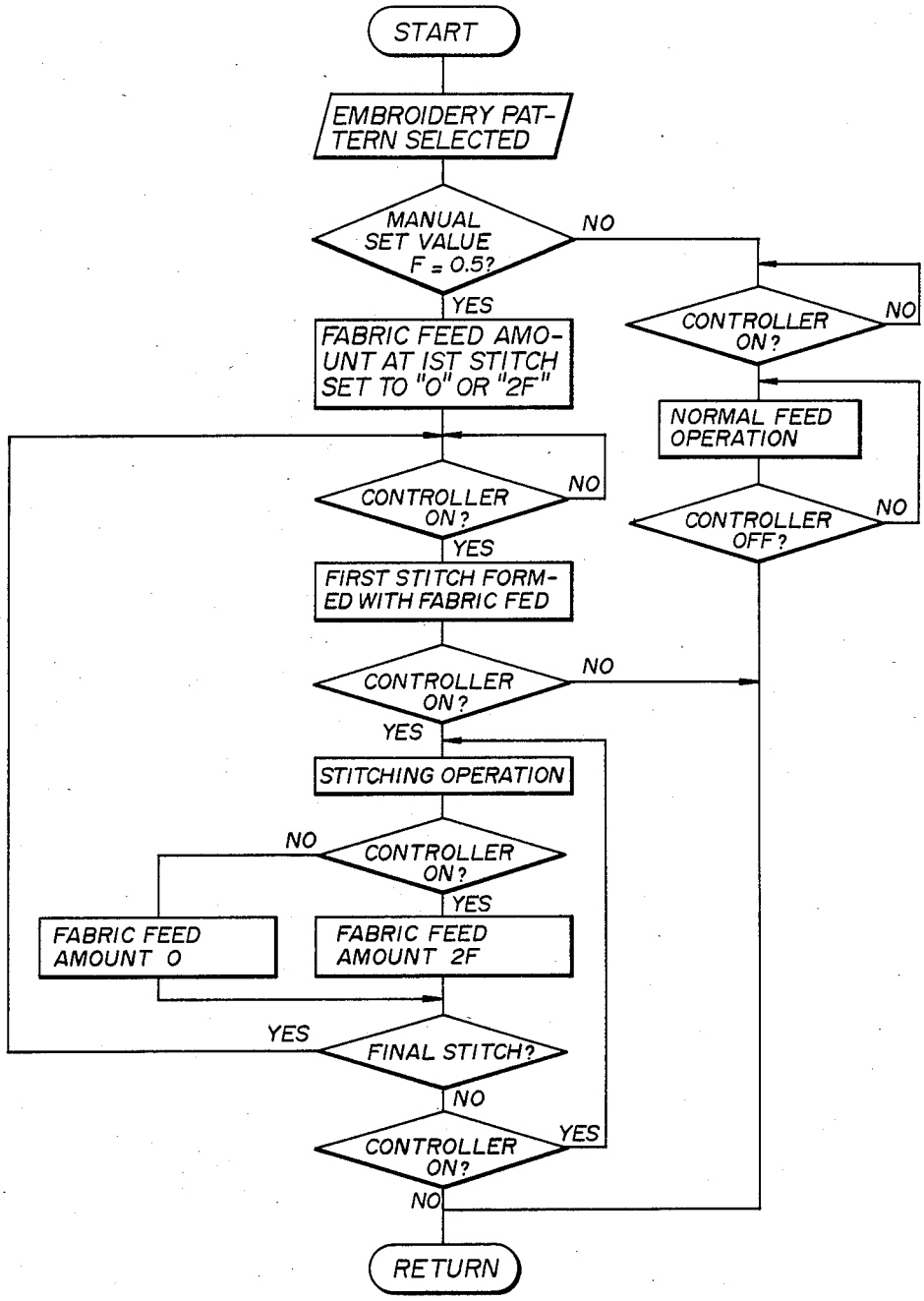
FIG. 8 is a flow chart of the fabric feed control operation of the invention.

The fabric feed control operation in accordance with the invention will be further described while referring to the flow chart of FIG. 8.

When the pattern selection unit 10 is so operated as to designate one of the embroidery patterns such as shown in FIG. 1 and when the predetermined set value thereof (0.4 mm) is manually adjusted to a value F of 0.5 mm or smaller, the alternate fabric feed operation will run as follows: First, the fabric feed amount to be applied to the first stitch of the designated pattern is automatically determined by the pattern data calculator 19 to be a selective one of zero and 2F (that is, double the manually selected value). The first feed amount of zero or 2F is determined in dependence upon the shape or configuration of the selected pattern and the first needle position of the pattern.

Then, a controller of the sewing machine is operated to cause a needle to penetrate the fabric, and after the needle comes up from the fabric, the fabric is fed by a value (zero or 2F) as having been calculated by the calculator 19, to thereby produce the first stitch of the pattern. Then, the next second stitch is produced with the fabric feed amount which is one of zero and 2F other than the preceeding first fabric feed amount. Namely, if the fabric feed amount at the first stitch is zero the second feed amount will be 2F, and if the former is 2F is the latter zero. Continuous operation of the controller will suffice the alternate feeding operation wherein the fabric feed amount of 2F is applied to alternate stitches. After the last stitch of the pattern has been completed, the first stitch of the same pattern may be successively connected thereto, as shown in FIG. 1.

When the embroidery pattern is to be stitched with the normally controlled feeding amount F exceeding 0.5 mm, not the alternate feeding operation but the normal and conventional feeding operation is adopted so that the respective stitches will be produced with a constant feed amount of the selected value F.

In accordance with the method of the invention, even if the minimum angular step of the pulse motor remains unchanged, the fabric feed amount can be definitely controlled within a wider choice of region, than by the conventional method. Provided the fabric feed amount corresponding to the minimum angular step of the pulse motor is 0.2 mm, the actual fabric feed amounts obtainable by the conventional method will only be 0.2 mm, 0.4 mm, 0.6 mm, 0.8 mm, 1.0 mm—whereas according to the invention the average or apparent feeding amounts of 0.1 mm, 0.3 mm and 0.5 mm can be selected in addition to values obtained by the conventional method.

While the invention has been described in conjunction with specific embodiments thereof, it is to be understood that many other variations and modifications may be made without departing from the true spirit and scope of the invention as defined by the appended claims.

What we claim is:

1. A method of producing patterns of zigzag stitches on a fabric with a sewing machine having an electronic memory storing stitch control information for said patterns, said stitch control information including data for controlling a pulse motor which is steppingly operated on a basis of a minimum angular step to control a position of a needle with respect to the fabric and data for controlling a second pulse motor which is steppingly operated on a basis of a minimum angular step to control a fabric feeding amount with respect to the needle, said needle position control data and said fabric feeding amount control data being selectively and sequentially read out from the electronic memory to control formation of the patterns, said method comprising the steps of:

selecting one of said patterns composed of densely arranged zigzag stitches each accompanied by a fabric feeding amount predetermined by said minimum angular step of said feed control pulse motor;

selecting an adjustment of said predetermined fabric feeding amount of said selected pattern;

selecting a digital value required for said adjustment of said predetermined fabric feeding amount of said selected pattern to a value not exceeding a predetermined critical value; and programming a calculator to make a calculation doubling said selected digital value to thereby control said second pulse motor with said calculated value, and to drive said second pulse motor each time an alternate stitch has been formed.

2. The method according to claim 1 wherein said adjusted fabric feeding amount to be applied to a first stitch of said selected pattern is a selective one of zero and said calculated value, in dependence upon the shape of said selected pattern and the needle position at the first stitch thereof.

3. The method according to claim 1 wherein said programming includes a step to operate said calculator to make effective said critical value when the latter is selected, said calculator being operated to control said feed control pulse motor with said critical value each time each stitch of said selected pattern has been formed up.

* * * * *